US009440365B2

(12) United States Patent
Park et al.

(10) Patent No.: US 9,440,365 B2
(45) Date of Patent: Sep. 13, 2016

(54) RECIPROCATING LINEAR RAZOR

(75) Inventors: Young Ho Park, Gyeonggi-Do (KR); Jae Jun Lee, Seoul (KR)

(73) Assignee: DORCO CO. LTD, Yongin-si (KR)

( * ) Notice: Subject to any disclaimer, the term of this patent is extended or adjusted under 35 U.S.C. 154(b) by 479 days.

(21) Appl. No.: 13/821,264

(22) PCT Filed: Sep. 16, 2011

(86) PCT No.: PCT/KR2011/006871

§ 371 (c)(1),
(2), (4) Date: Mar. 7, 2013

(87) PCT Pub. No.: WO2012/036515

PCT Pub. Date: Mar. 22, 2012

(65) Prior Publication Data

US 2013/0160296 A1 Jun. 27, 2013

(30) Foreign Application Priority Data

Sep. 17, 2010 (KR) ..... 10-2010-0091971

(51) Int. Cl.

| | |
|---|---|
| ***B26B 21/38*** | (2006.01) |
| ***B26B 21/40*** | (2006.01) |
| ***B26B 21/52*** | (2006.01) |
| ***B26B 21/36*** | (2006.01) |

(52) U.S. Cl.

CPC ..... *B26B 21/38* (2013.01); *B26B 21/36* (2013.01); *B26B 21/40* (2013.01); *B26B 21/52* (2013.01)

(58) Field of Classification Search

CPC ..... B26B 19/14; B26B 19/45; B26B 21/00; B26B 19/3853; B26B 21/4081; B26B 19/141; B26B 19/143

USPC ..... 30/42, 40, 34.1, 50, 346.5, 346.57, 30/43.4, 43.6, 45, 43.91

See application file for complete search history.

(56) References Cited

U.S. PATENT DOCUMENTS

| | | | | |
|---|---|---|---|---|
| 4,490,907 | A | 1/1985 | Benedictus | |
| 4,642,892 | A | 2/1987 | Ishida | |
| 4,930,217 | A | 6/1990 | Wolf et al. | |
| 5,191,712 | A * | 3/1993 | Crook et al. | 30/34.2 |
| 5,299,354 | A * | 4/1994 | Metcalf et al. | 30/45 |
| 6,298,557 | B1 * | 10/2001 | Gilder | 30/34.2 |
| 6,516,518 | B1 * | 2/2003 | Garraway et al. | 30/34.2 |
| 7,178,241 | B1 * | 2/2007 | Cummings et al. | 30/41 |
| 7,441,336 | B2 * | 10/2008 | Hawes et al. | 30/45 |
| 2001/0029669 | A1 * | 10/2001 | Ferraro et al. | 30/49 |
| 2002/0189103 | A1 * | 12/2002 | Brown | B26B 21/00 30/50 |
| 2006/0143925 | A1 * | 7/2006 | Johnson et al. | 30/50 |
| 2008/0256800 | A1 * | 10/2008 | Nicoll | 30/50 |
| 2010/0205808 | A1 * | 8/2010 | King | 30/34.2 |

(Continued)

FOREIGN PATENT DOCUMENTS

| | | | |
|---|---|---|---|
| CN | 1608810 | A | 4/1999 |
| CN | 1890066 | A | 1/2007 |
| JP | 03-119370 | U | 12/1991 |

(Continued)

*Primary Examiner* — Ghassem Alie

(74) *Attorney, Agent, or Firm* — STIP Law Group, LLC

(57) ABSTRACT

The present invention pertains to a razor, which includes: a gripping section combined with a housing; a head section coupled at one side of the housing; a razor blade cartridge mounted at a front surface of an upper end of the head section; and an eccentric cam module, which moves the razor blade cartridge to reciprocate in a cutting direction.

15 Claims, 8 Drawing Sheets

(56) References Cited

U.S. PATENT DOCUMENTS

| | | | | |
|---|---|---|---|---|
| 2011/0126413 | A1* | 6/2011 | Szczepanowski et al. | 30/41 |
| 2012/0151772 | A1* | 6/2012 | Moon et al. | 30/41 |

FOREIGN PATENT DOCUMENTS

| | | | |
|---|---|---|---|
| JP | 2002-512870 | A | 5/2002 |
| JP | 2007-512891 | A | 5/2007 |
| JP | 2008-093034 | A | 4/2008 |
| JP | 2009-502408 | A | 1/2009 |
| JP | 2010-523298 | A | 7/2010 |
| KR | 10-1997-0006235 | B1 | 4/1997 |
| KR | 10-2006-0089246 | A | 8/2006 |
| KR | 10-2006-0122880 | A | 11/2006 |
| WO | 2007015220 | A1 | 2/2007 |

* cited by examiner

RECIPROCATING LINEAR RAZOR

CROSS-REFERENCE TO RELATED APPLICATION

This application claims the benefit of Korean Patent Application No. 10-2010-0091971, filed on Sep. 17, 2010 in the Korean Intellectual Property Office, the disclosure of which is incorporated herein by reference.

TECHNICAL FIELD

The present invention relates to a razor, and more particularly, to a reciprocating linear razor.

BACKGROUND ART

Generally, a razor is used for cutting body hair such as hair or beard grown in a body to remove them, by using a razor blade. The razor can be categorized into a razor manually cutting body hair, an electric razor operated by a motor, or the like. In particular, an electric razor can be categorized into a rotary razor, a razor using a linear motor, or the like, according to a driving source, for example, a motor driving type.

Recently, research in terms of structure reinforcement for assisting a blade function to improve a shaving performance, as well as a razor blade is being actively researched. For example, there is a lubricating band.

Moreover, an electric razor uses a disposable battery cell or a rechargeable battery as a power supply.

Also, a rotary-type head unit of an electric razor may be provided to tightly contact skin so as to improve a performance of cutting body hair, and a method of cleaning a head unit of a razor may be used in consideration of improvement of cutting function, cleanliness, hygiene or the like.

Among the general electric razors, a vibrating razor generates a vibration in a surface of a razor cartridge to often provide skin, beard, or beard with a calming effect.

Moreover, a razor can be categorized into a wet type and a dry type. The above described wet type razor has an outstanding hair cutting performance. However, a cream, a soap bubble or the like has to be applied to skin so as to use the wet type razor, before shaving. Therefore, much time is taken in shaving, and it is uneconomical.

A dry type razor is driven by a motor or the like to cut body hair. A dry type razor is more convenient in use than a wet type razor, and is economical. However, cut body hair remains in a dry type razor more than in a wet type razor.

These various types of razors are perceived as necessity of modern people. Therefore, a razor, which is economical, can be used regardless of time and space, can be more conveniently used and has an improved cutting force, is required.

DISCLOSURE OF INVENTION

Accordingly, the present invention is directed to provide a reciprocating linear razor, which substantially obviates one or more problems due to limitations and disadvantages of the related art. An aspect of the present invention is directed to provide a reciprocating linear razor, which improves a cutting force by using a reciprocating linear motion providing vibration force generated by a rotation of an eccentric cam, in a cutting direction.

Moreover, another aspect of the present invention is directed to provide a reciprocating linear razor which is economical.

Moreover, another aspect of the present invention is directed to provide a reciprocating linear razor, which includes a razor cartridge configured with a bi-directional razor blade and first and second guards in the duplex razor blade, and thus, improves cutting force resulting from expansion/compression effect and provides a convenient shaving.

Moreover, another aspect of the present invention is directed to provide a reciprocating linear razor including a blade cartridge which is convenient to be attached and detached.

Moreover, another aspect of the present invention is directed to provide a reciprocating linear razor which includes a vacuum guard formed of an elastic material, performs a vacuum pump function, and thus, improves cutting force.

Moreover, the other aspect of the present invention is directed to provide a reciprocating linear razor which includes a head unit configured to be able to rotate step by step, can change a cutting direction of a razor blade cartridge, and thus, can be used to shave by oneself or by others.

To achieve these and other advantage and in accordance with the purpose of the invention, as embodied and broadly described herein, there is provided a reciprocating linear razor, which includes: a housing functioning as a grip unit; a head unit coupled to one side of the housing; a razor blade cartridge disposed in a front surface of an upper portion of the head unit for cutting; and an eccentric cam module making the razor blade cartridge perform a reciprocating motion in a cutting direction.

The reciprocating linear razor may further comprises at least one or more of vacuum-guards formed parallel to the razor blade cartridge in a front surface of the head unit, wherein, the vacuum-guard may perform a vacuum pump function and massage effect, and thus, improve cutting force.

When a vibration is generated by a reciprocating motion of the razor blade cartridge, the vacuum-guard may vibrate together, and thus, a compression motion and an expansion motion may be provided.

The vacuum-guard may comprise a plurality of tube-shaped hollow units disposed in a horizontal direction and vertical direction to be adjacent to each other, and formed of elastic material to maximize suction force.

The vacuum-guard may comprise a first guard adjacent to the razor blade cartridge in one side of a cutting direction of the razor blade cartridge, and disposed parallel to the razor blade cartridge; and a second guard adjacent to the razor blade cartridge in other side of the cutting direction of the razor blade cartridge 30, disposed parallel to the razor blade cartridge and the first guard, disposed in the same plane as the first guard, and disposed to face the first guard with respect to the razor blade cartridge.

A plurality of protrusions formed in a cylindrical shape or in a square pillar shape may be disposed in a line in a periphery of a side direction of a front surface of the head unit, and a portion of the vacuum-guard may be coupled to the protrusion.

A pair of linear bases may be disposed in a periphery of a direction vertical to a side direction of a front surface of an upper portion of the head unit to support the razor blade cartridge, and the linear bases may support the razor blade cartridge such that the razor blade cartridge smoothly moves when the razor blade cartridge performs an up-and-down motion.

A razor blade of the razor blade cartridge may be fixed to the razor blade cartridge by a clip.

The eccentric cam module may comprise a driver accommodated in the housing; an eccentric cam unit disposed in the same shaft as the driver and disposed adjacent to the razor blade cartridge to provide the razor blade cartridge with up-and-down vibration depending on an operation of the driver 120; and speed change gears disposed between the driver and the eccentric cam unit in the same shaft as the driver and the eccentric cam unit.

The razor blade cartridge and a vacuum-guard may be configured to be attached to and detached from a front surface of an upper portion of the head unit, and each of the side elastic cover guides may be symmetrically disposed in both sides of the head unit to fix the razor blade cartridge and the vacuum-guard, the both sides being vertical to a cutting direction of the razor blade cartridge.

The side elastic cover guide may comprise a bending unit coupling one side of the razor blade cartridge and the vacuum-guard to the front surface of the upper portion of the head unit; a rotation supporting unit integrally formed with the bending unit 410, extended from the bending unit 410 and rotatably accommodated in a side portion of the head unit to be coupled to the head unit; and an elastic supporting unit integrally formed with the rotation supporting unit, extended from the rotation supporting unit and disposed to be accommodated in a head unit lower portion.

The razor blade of the razor blade cartridge may be configured with razor blades facing each other or multi-stage blades facing each other.

The razor blade cartridge and vacuum-guard may be configured to be replaced together.

The head unit may be coupled to the housing to rotate, and thus, a cutting direction of the razor blade cartridge may be changed.

The reciprocating linear may further comprise a rotation angle adjusting unit disposed between the head unit and the housing, wherein, the rotation angle adjusting unit may comprise a plurality of grooves formed in an inner circumference surface of a head unit lower portion at an equal distance; and a plurality of protrusions formed in an outer circumference surface of a housing upper portion at a certain distance to be coupled to the grooves, and a rotation angle of the head unit may be adjusted step by step.

ADVANTAGEOUS EFFECTS

As described above, the razor according to the present invention is improved in body hair cutting force, and more particularly, can provide convenient shaving.

In particular, the razor according to the present invention improves a cutting force by using a reciprocating linear motion, which provides vibration force generated by a rotation of an eccentric cam, in a cutting direction, and includes two vacuum guards functioning as a vacuum pump to induce a suction of body hair to increase cutting force of adjacent razor blades.

Also, the razor according to the present invention can maximize pumping effect, which eliminates sebum in pore of the skin by using suction force of a vacuum guard, and skin calming effect, and thus, can improve a shaving performance.

Moreover, the razor according to the present invention is economical because the razor has few components, and thus, can be provided in a low price. Also, the razor can include a razor cartridge configured with a bi-directional razor blade and first and second guards in the duplex razor blade, and thus, improve cutting force to provide a convenient shaving.

Moreover, in the razor according to the present invention, a razor blade cartridge and a vacuum guard are convenient to be attached and detached, and a cutting direction of a razor blade cartridge can be changed, and thus, the razor can be used to shave by oneself or by others.

BRIEF DESCRIPTION OF DRAWINGS

The accompanying drawings, which are included to provide a further understanding of the invention and are incorporated in and constitute a part of this application, illustrate embodiments of the invention and together with the description serve to explain the principle of the invention.

In the drawings.

MODES FOR CARRYING OUT THE INVENTION

Figure 1:
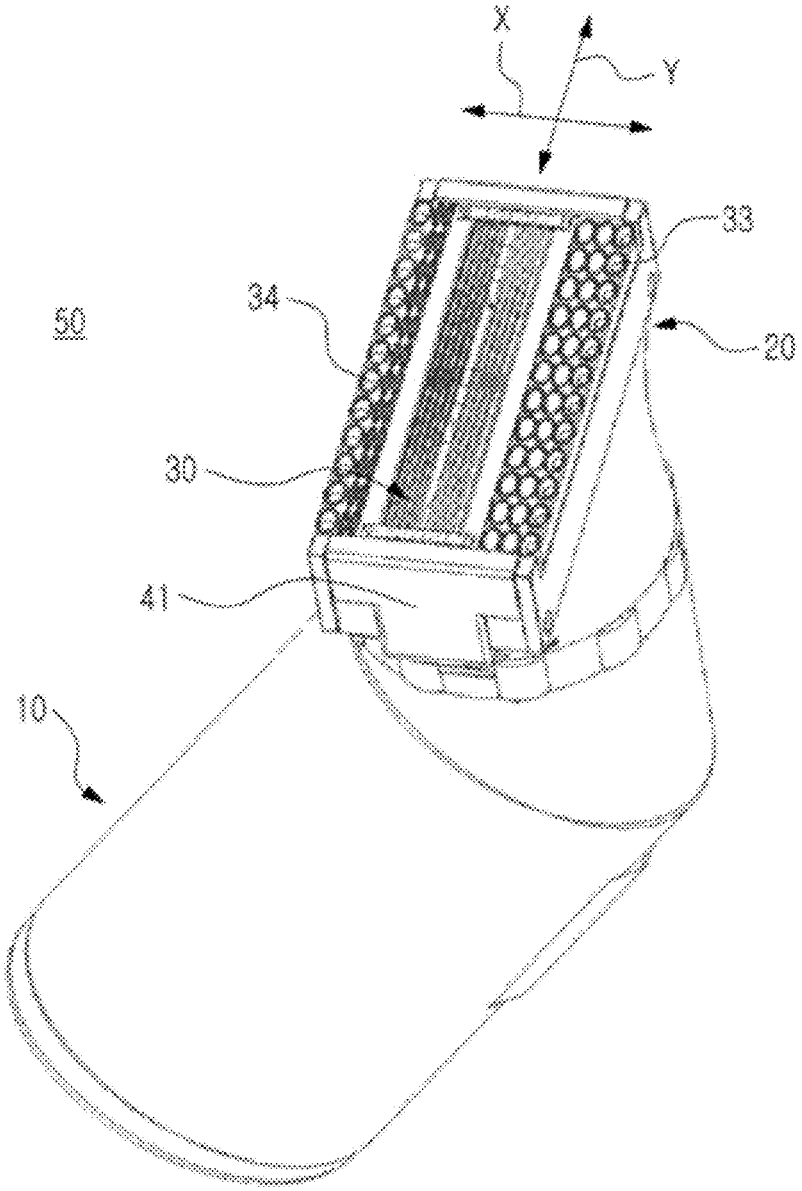
FIG. 1 is an assembled perspective view illustrating a configuration of a razor according to the present invention.

Reference will now be made in detail to the exemplary embodiments of the present invention, examples of which are illustrated in the accompanying drawings. Wherever possible, the same reference numbers will be used throughout the drawings to refer to the same or like parts. Hereinafter, embodiments of the present invention will be described in detail with reference to the accompanying drawings.

Shown in FIGS. 1 to 4, the razor 50 according to the present invention provides vibration force with a razor blade cartridge 30 by using an up-and-down reciprocating movement (direction of X) generated by an eccentric cam 130, and includes two vacuum guards 33 and 34 in head unit housings 200. Therefore, the razor can provide a compression motion and an expansion motion to improve body-hair cutting force, and thus, is economical and convenient. Up-and-down reciprocating vibration force is provided to the razor blade cartridge 30 by the vibration force, this is referred to as a reciprocating linear motion, and this type razor is referred to as a reciprocating linear razor.

A direction of X shown in FIG. 1 designates a cutting direction of the razor, and a direction of Y designates a vertical direction of the cutting direction of the razor.

In FIG. 1, an assembled state where a razor blade cartridge 30 and two guards 33 and 34 are assembled in a front surface of an upper portion of a head unit 20 is shown. The reciprocating linear razor 50 (hereinafter referred to as a razor) includes a housing 10, a head unit 20, razor blade cartridge 30 and an eccentric cam module 15 (shown in FIGS. 2 to 4). Appearance of the razor is configured with the housing 10, the head unit 20 and the razor blade cartridge 30.

Figure 2:
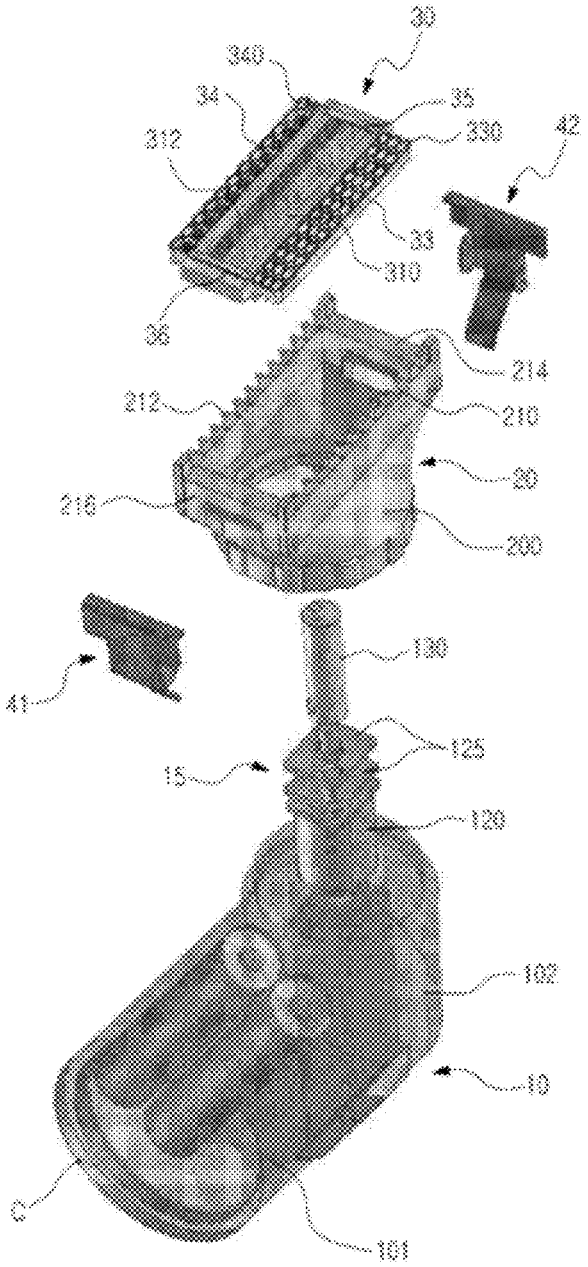
FIGS. 2 to 4 are exploded perspective views illustrating configurations of a razor, which is shown in various angles, according to the present invention.
Figure 3:
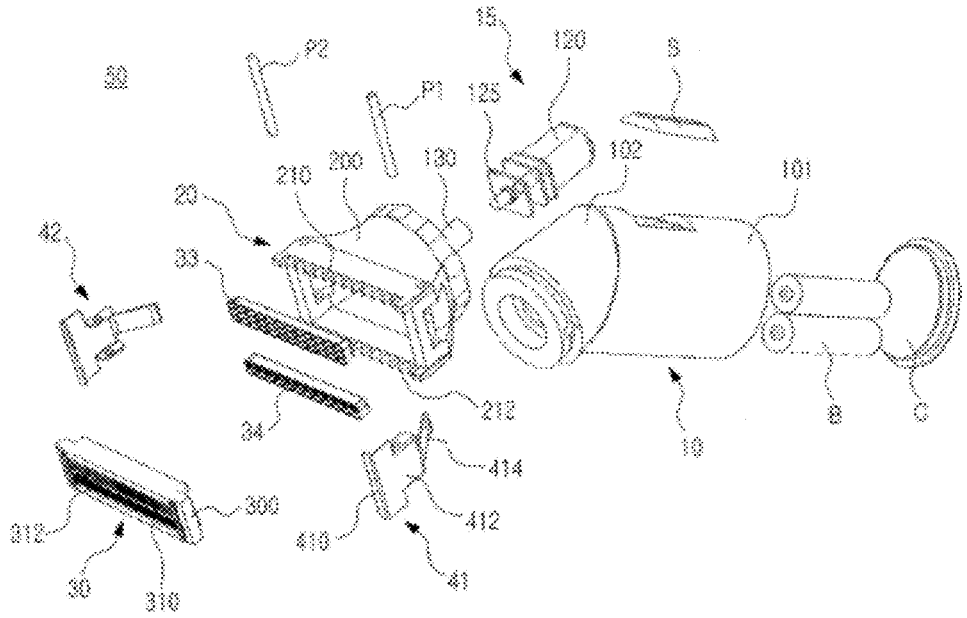
Figure 4:
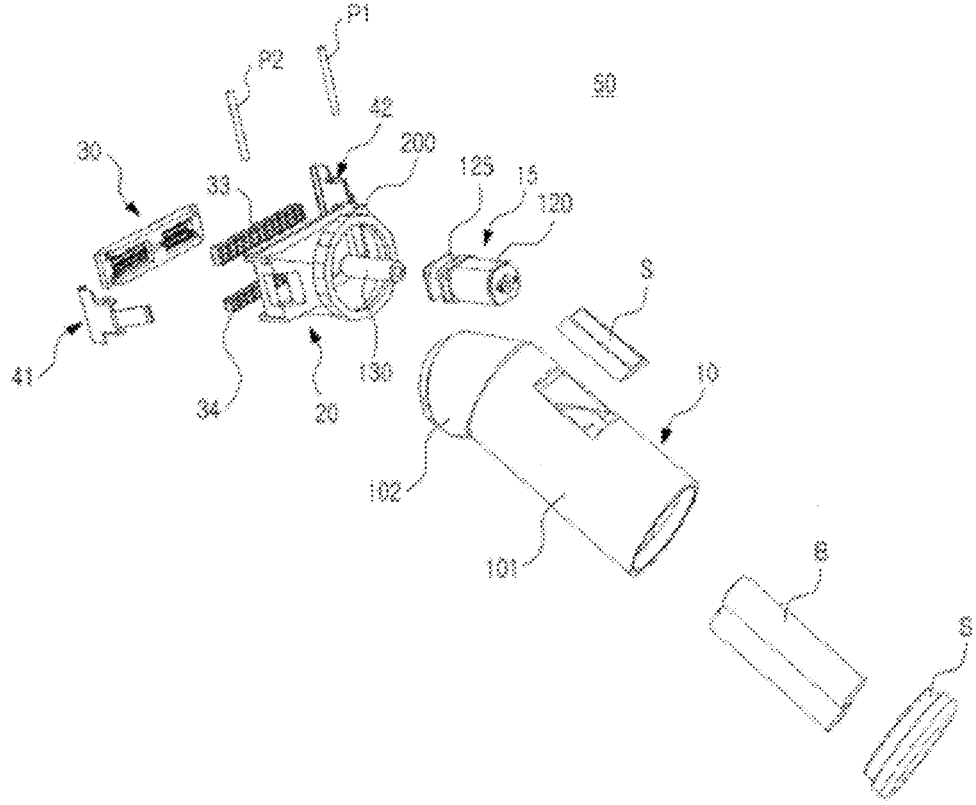

As shown in FIGS. 2 to 4, the housing 10 includes a body housing 101, which also functions as a grip unit and accommodates a switch including a circuit board, a power supply B, for example, a disposable battery cell and a rechargeable cell. Also, the housing 10 includes an inclined housing 102 extended from the body housing 101 to an inclined direction. The inclined housing 102 may be used as a grip unit. The body housing 101 includes a switch which turns on or off a power and is mounted on a certain position of an outer circumference surface. The inclined housing 102 provides a user with a grip motion which is convenient to bring the razor into contact with body hair of skin.

The razor blade cartridge 30 is a unit which is disposed in a front surface of an upper portion of the head unit (head unit housing) 20 to cut body hair or the like. The razor blade cartridge 30 is configured to be attached to and detached from the head unit 20 in a state where the razor blade cartridge 30 is being fastened to the head unit 20 by a side elastic cover guides 41 and 42 described below. The razor blade cartridge 30 may be configured with one or more, and particularly, a plurality of multi-stage blades 310 and 312. In particular, when a plurality of razor blades are used, the razor blades can be disposed in a cartridge housing 300 so as to face each other, two multi-stage razor blades each of which is configured with blades may be disposed so as to face each other, and at least one or more blades may be disposed so as to face each other. That is, the razor blade cartridge 30 may be configured with two multi-stage blade cartridge facing each other in a inclined state, for improvement of cutting force and a convenient. Here, the described-above blades 310 and 312 are disposed to be inclined for outstanding cutting efficiency. An inclined angle of a razor blade for outstanding cutting force may be formed variously considering body hair cutting direction. Here, both end sides of razor blades 310 and 312 of the razor blade cartridge are fixed by clips 35 and 36.

The head unit 20 includes a head unit housing 200 coupled to the inclined housing 102, and the razor blade cartridge 30 is mounted on the head unit 20. The razor blade cartridge 30 is mounted on a front surface of an upper portion of the head unit 20, that is, a front surface of an upper portion of the head unit housing 200 (a sectional surface of a vertical direction of the head unit housing) in parallel with the front surface. Moreover, a plurality of protrusions 210 and 212 are disposed in a linear periphery of a side direction of a front surface of the head unit 20. The plurality of protrusions 210 and 212 are positions to which a portion of each of below-described vacuum-guards 33 and 34 is coupled. The protrusions 210 and 212 are disposed in a line, and each of the protrusions 210 and 212 is formed in a cylindrical shape or in a square pillar shape.

Also, the protrusions 210 and 212 are configured with a first protrusion 210 and a second protrusion 212 for installing the two vacuum-guards 33 and 34. The first protrusion 210 and the second protrusion 212 are disposed in a front periphery of the head unit (a direction vertical to a cutting direction, that is, a periphery of a position where blades are disposed) so as to face each other. In particular, each of the first protrusion 210 and the second protrusion 212 protrudes to face a direction vertical to a cutting direction of the razor blade cartridge 30. Here, the direction vertical to the cutting direction is a direction vertical to a front surface of the head unit housing).

Moreover, the razor 50 further includes at least one or more vacuum-guards 33 and 34 which are parallel to the razor blade cartridge 30 and are disposed in a front surface of the head unit 20. The vacuum-guards 33 and 34 function as a vacuum pump during shaving to stand body hair on skin contacting the vacuum-guards to make a razor blade easily cut the body hair. Also, the vacuum-guards 33 and 34 provide skin massage effect.

Each of the vacuum-guards 33 and 34 is formed in a shape where various vacuum holes are disposed in a horizontal direction and vertical direction to be adjacent to each other, and each of the vacuum-guards 33 and 34 includes a plurality of tube-shaped hollow units 330 each of which is formed of elastic material to maximize suction force. That is, the hollow units 330 are disposed in a horizontal direction and vertical direction to be adjacent to each other to provide a vacuum-guard. In particular, the hollow units 330 are formed of elastic material, and particularly, rubber material. Therefore, suction force of the hollow units 330 is excellent, the hollow units 330 can smoothly perform a vacuum pump function, and contribute to an improvement of body-hair cutting force. Elastic characteristic of the vacuum-guard is flexible enough to be interlocked with the razor blade cartridge when the razor blade cartridge is performing a reciprocating movement to vibrate. The vacuum-guard of the present invention is alternately compressed and expanded by a repetitive up-and-down (a direction of X) movement of the razor blade cartridge, and thus, shows suction effect of vacuum pump guard. That is, the vacuum-guards 33 and 34 generate suction force by using a vibration, and thus, skin-drawing effect is maximized, and sebum and body waste in pore of the skin can be eliminated. A shape of the vacuum-guards 33 and 34 applied to the razor according to the present invention needs not to be limited to the shape of the tube-shaped hollow units 330, but may be basically formed in a tube shape, and it is apparent that a shape of the vacuum-guards 33 and 34 can be modified to an advantageous shape for being sucked into skin having body hair. For example, among areas in a front surface of the hollow unit, an area contacting skin may be increased for suction function.

Portions of the vacuum-guards 33 and 34 are respectively coupled to a first protrusion 210 and a second protrusion 212 formed in a periphery of a side direction of a front surface of the head unit 20.

The vacuum-guard includes a first guard 33 and a second guard 34. The first guard 33 is adjacent to the razor blade cartridge 30 in one side of a cutting direction of the razor blade cartridge 30, and is disposed parallel to the razor blade cartridge 30. The second guard 34 is adjacent to the razor blade cartridge 30 in other side of the cutting direction of the razor blade cartridge 30, is disposed parallel to the razor blade cartridge 30 and the first guard 33, is disposed in the same plane as the first guard 33, and is disposed to face the first guard with respect to the razor blade cartridge 30. The first and second guards 33 and 34 may be disposed to be symmetrical or asymmetrical with respect to the razor blade cartridge 30.

The number of the hollow unit disposed in the first guard 33 and the number of the hollow unit disposed in the second guards 34 may be different. That is, the number of the hollow unit disposed in the first guard 33 may be greater than the number of the hollow unit disposed in the second guards 34. On the other hand, the number of the hollow unit disposed in the first guard 33 may be smaller than the number of the hollow unit disposed in the second guards 34.

Moreover, a pair of linear bases 214 and 216 are disposed in a periphery of a direction vertical to a side direction of a front surface of an upper portion of the head unit 20. The linear bases 214 and 216 are members supporting the razor blade cartridge 30, and particularly, perform a function of supporting the razor blade cartridge 30 such that the razor blade cartridge 30 smoothly moves when the razor blade cartridge 30 performs a linear motion (an up-and-down reciprocating motion). The razor blade cartridge 30 and the vacuum-guards 33 and 34 are supported in the head unit 20 by the linear bases 214 and 216, and may be configured to be attached to and detached from the head unit 20 by the linear bases 214 and 216, and thus, can be replaced in the head unit 20.

When the eccentric cam module 15 is operated, the eccentric cam module 15 provides the razor blade cartridge 20 with up-and-down reciprocating movement force to make the razor blade cartridge 20 perform a linear motion, and at the same time, the vacuum-guards 33 and 34 vibrate with the razor blade cartridge 20 to provide a compression motion and a expansion motion. That is, the vacuum-guards 33 and 34 function as a power supply. The eccentric cam module 15 includes a driver 120 accommodated in one side of the housing 10 to provide a driving source, an eccentric cam unit 130 disposed in the same shaft as the driver 120 and adjacent to the razor blade cartridge 30 to provide the razor blade cartridge 30 with up-and-down reciprocating vibration depending on an operation of the driver 120, and speed change gears 125 disposed between the driver 120 and the eccentric cam unit 130, in the same shaft as the driver 120 and the eccentric cam unit 130. Also, the eccentric cam unit 130 is configured such that a cam can eccentrically rotate with respect to a motor. Therefore, the eccentric cam generates vibration force depending on a rotation of the driver 120. The gears 125 may be configured with a gear module reducing a rotation speed of the motor. A general motor is used as the above-described driver 120.

The razor blade cartridge 30 and the vacuum-guards 33 and 34 are configured such that the razor blade cartridge 30 and the vacuum-guards 33 and 34 are maintained to be parallel to the front surface of the upper portion of the head unit 20 by at least one or more of the side elastic cover guides 41 and 42. The side elastic cover guides are configured with a first side elastic cover guide 41 and a second side elastic cover guide 42, are members to respectively fix one side and other side of the razor blade cartridge 30 and the first and second guards 33 and 34, and are respectively coupled to both sides of the head unit housing 200 in a direction vertical to the cutting direction. The first and second side elastic cover guides 41 and 42 are formed in the same shape and perform the same function, and thus, only the first side elastic cover guide 41 will be described below. The first and second side elastic cover guides 41 and 42 are respectively disposed in outer circumference surfaces of both sides of the head unit 20 so as to symmetrically face each other, and thus, fix the razor blade cartridge 30 and the first and second guards 33 and 34 such that the razor blade cartridge 30 and the first and second guards 33 and 34 are not separated from the head unit 20. The first side elastic cover guide 41 includes a bending unit 410 coupling one side of the razor blade cartridge 30 and the first and second guards 33 and 34 to the front surface of the upper portion of the head unit 20, a rotation supporting unit 412 integrally formed with the bending unit 410, extended from the bending unit 410 and rotatably accommodated in a side portion of the head unit 20 to be coupled to the head unit 20, and an elastic supporting unit 414 integrally formed with the rotation supporting unit 412, extended from the rotation supporting unit 412 and disposed so as to be supported by a lower portion of the head unit 20. The rotation supporting unit 412 is accommodated in an open part formed in the head unit to be rotatably coupled by a hinge pin P1 or P2. The razor blade cartridge 30 and the vacuum-guards 33 and 34 can be attached and detached by the first and second side elastic cover guides.

In the above-described razor 50, if the switch S is turned on, vibration force generated by a drive of the eccentric cam module 15 is provided to the razor blade cartridge 30 in an up-and-down direction (a direction of X) with a reciprocating motion. In this state, a user brings the razor blade cartridge 30 into contact with skin having body hair to cut the body hair by moving the razor blade cartridge 30 in a certain direction (a reciprocating direction). The first and second guards 33 and 34 suck the skin to perform a vacuum pump function, and thus, stand the body hair inside the hollow unit to improve cutting force. When the razor blade of the razor blade cartridge 30 is configured with bi-directional razor blades 310 and 312, the first guard 34 assists an adjacent razor blade 310 in cutting body hair, and the second guard 33 assists another adjacent razor blade 312 in cutting body hair.

In FIG. 1, it is shown that the razor blade cartridge is configured with bi-directional razor blades 310 and 312 facing each other. Here, each of the bi-directional razor blades 310 and 312 includes a plurality of razor blades. Moreover, a reference number C shown in FIGS. 3 and 4 denotes a cover coupled to a bottom surface of the housing 10.

Figure 5:
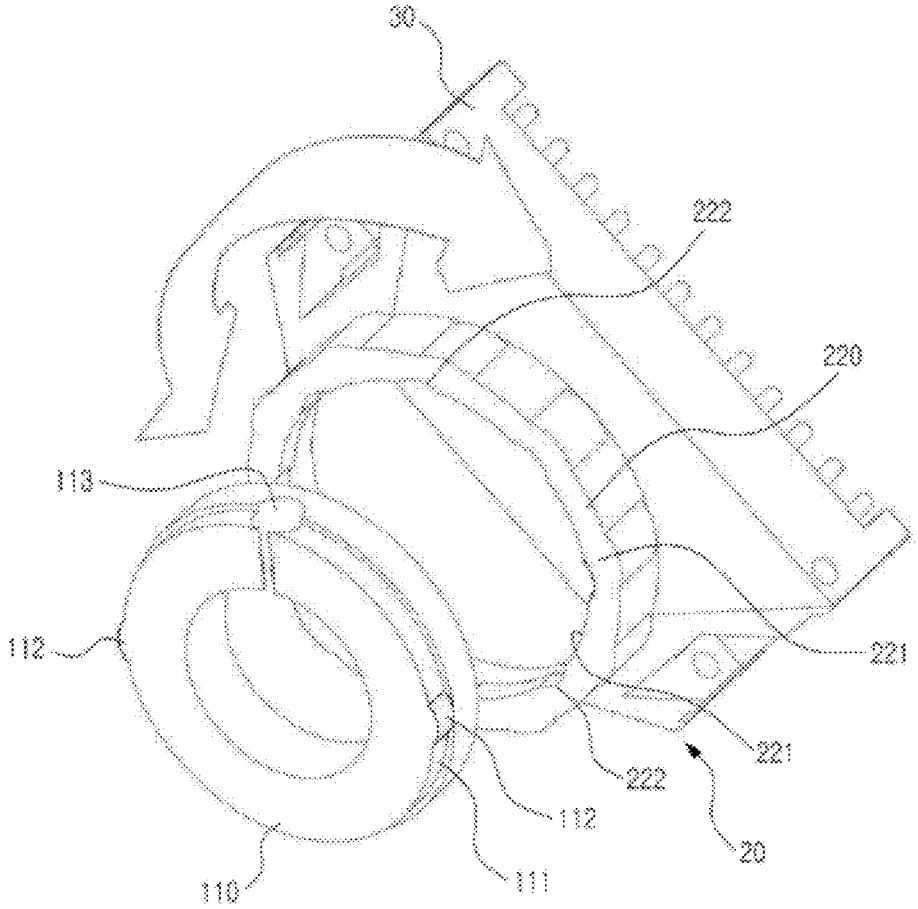
FIG. 5 is an exploded perspective view illustrating a configuration of a rotary angle adjusting unit changing a cutting direction of a razor according to the present invention.

As shown in FIG. 5, the head unit 20 is coupled to the housing, and more particularly, to an inclined housing upper portion 110 in the same shaft (in a direction of a rotation shaft of the eccentric cam module) and is rotatably configured, and thus, a cutting direction of the razor blade cartridge 30 can be changed. In particular, a rotation angle adjusting unit is disposed between the head unit 20 and the housing, and thus, a user can change the cutting direction of the razor blade cartridge 30 to a desired position step by step.

The rotation angle adjusting unit is disposed between the head unit 20 and the housing upper portion 110. The rotation angle adjusting unit includes a plurality of grooves 222 formed along a periphery of an inner circumference surface 221 of a head unit lower portion 220 at an equal distance, and a plurality of protrusions 112 formed in an outer circumference surface 111 of the housing upper portion 110 at a certain distance to be coupled to the grooves 222. Therefore, a rotation angle of the head unit 20 can be adjusted step by step. The grooves 222 is radially recessed, is extended to a coupling direction in which the head unit is coupled, and particularly, is formed in a curved shape, and thus, a rotation motion of the head unit 20 is simply done when the grooves is engaged with or separated from the protrusion 112.

During a rotation of the head unit 20, when the protrusion inserted into a chosen groove is separated from the groove and is again inserted into an adjacent groove, and thus, a rotation angle is adjusted, a sound of a clack is provided. Therefore, a user realizes a degree of a rotation of the head unit 20 by using the sense of hearing.

In FIG. 5, eight grooves 222 and two protrusions 112 are shown. When eight grooves are formed at an equal distance, a rotation angle between one groove and other groove is approximately an angle of 45 degrees.

In particular, an elastic open part 113 is formed between the protrusions 112, and thus, a rotation motion of the head unit 20 is simply done.

Figure 6:
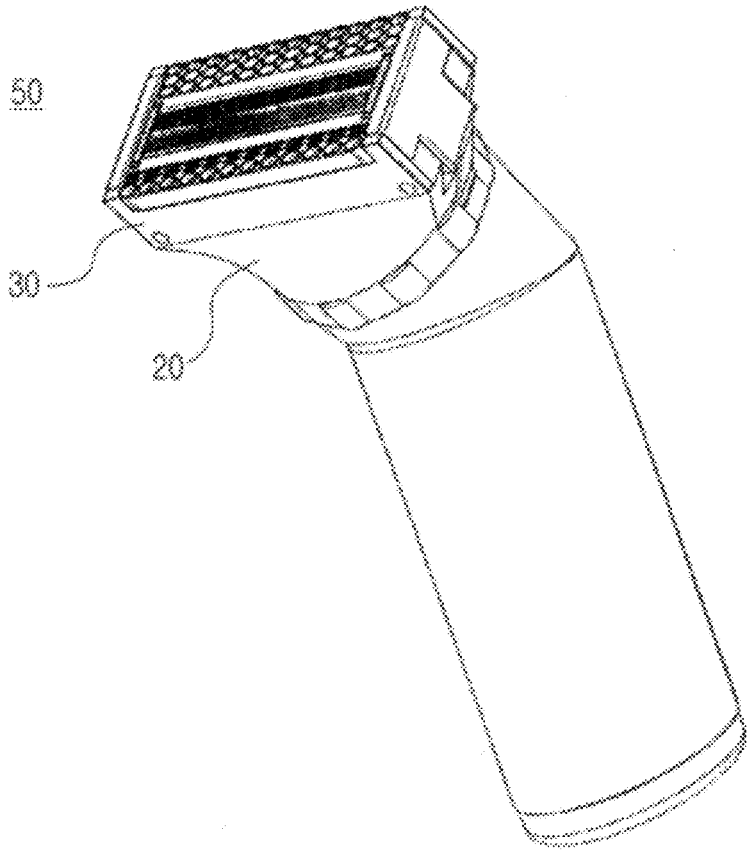
FIGS. 6 and 7 are perspective views illustrating a state where a cutting direction of a razor cartridge according to the present invention is changed to 90 degrees.
Figure 7:
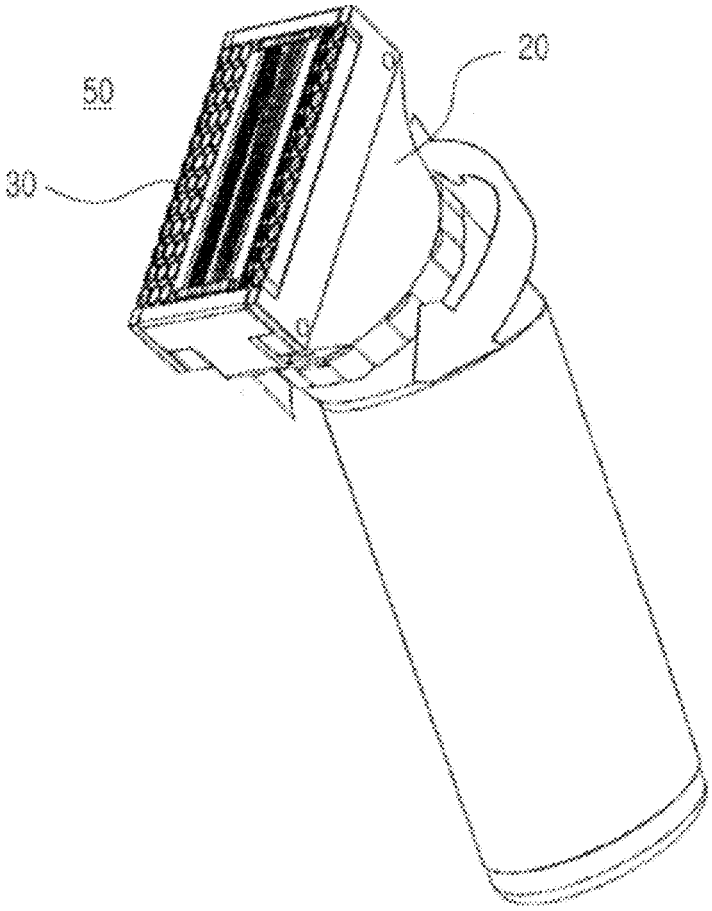

In FIGS. 6 and 7, a state where the head unit 20 rotates, and thus, a cutting direction of the razor blade cartridge 30 is changed is shown. Because the cutting direction of the razor 50 can be changed, a user can shave in a more convenient posture. For example, when a user shaves in person, it is convenient to use the razor 50 with the state shown in FIG. 6. However, when a user is shaved by others instead of shaving in person, it is convenient to use the razor 50 with the state shown in FIG. 7.

Figure 8:
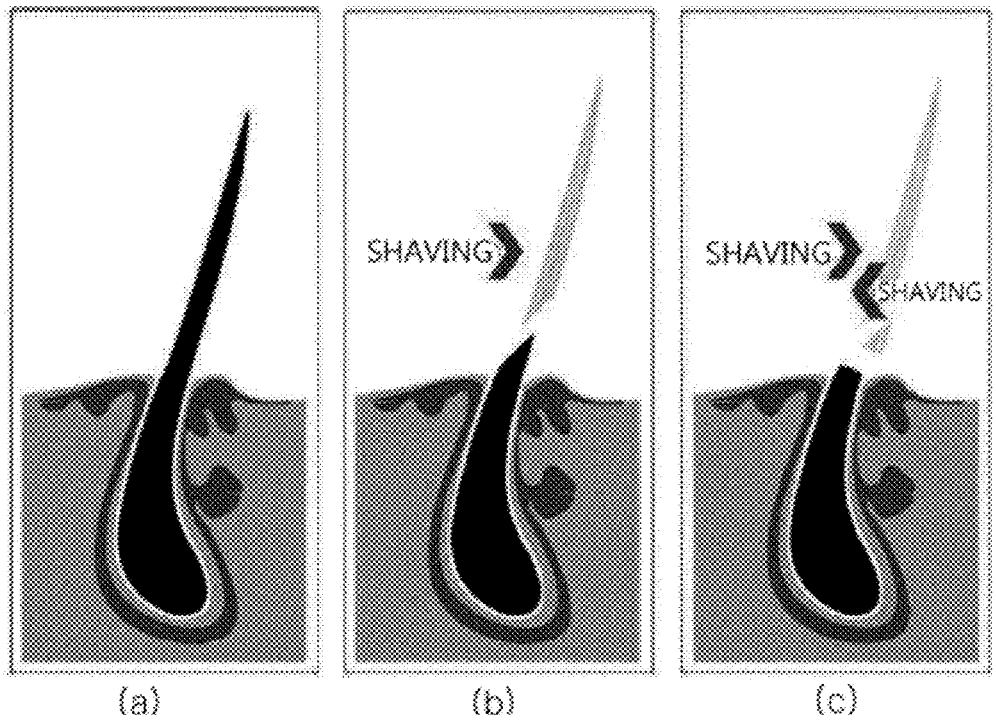
FIG. 8 is an exemplary diagram illustrating a cutting performance of a razor according to the present invention.

FIG. 8 is an exemplary diagram illustrating a cutting performance of a razor according to the present invention.

In present invention, because razor blades are disposed to face each other, a bi-directional cutting is possible. Therefore, a cutting performance is more excellent than an existing razor. As shown in a portion (b) of FIG. 8, hair is cut to be sliced when an existing wet type razor is used in shaving, and thus, a cross section is formed in a diagonal line shape to sharply protrude. On the other hand, because razor blades face each other in the present invention, even though hair is cut to be sliced as the existing wet type razor, the hair is quickly cut in other side. Therefore, the hair is cut more deeply, slope of a cross section is gentle, and a cross-sectional area becomes smaller.

Figure 9:
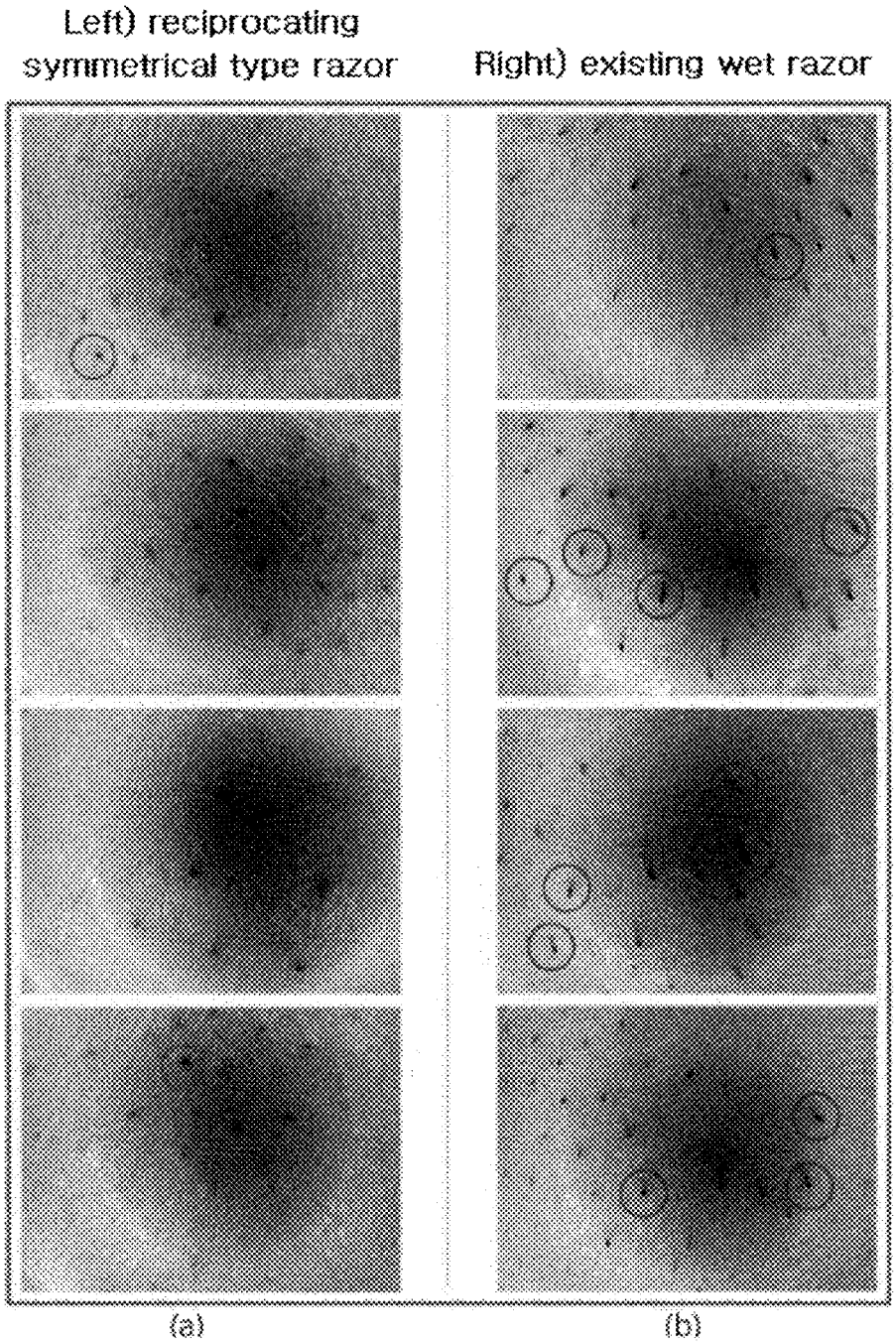
FIG. 9 is photographs really taken after shaving by using the razor according to the present invention and a related art razor.

FIG. 9 is photographs really taken after shaving by using the razor according to the present invention and a related art razor, a portion (a) of FIG. 9 is a photograph taken by the razor according to the present invention, and a portion (b) of FIG. 9 is a photograph taken by a related art razor. It is shown that the shaving by the razor according to the present invention is neater than the shaving by a related art razor.

The invention claimed is:

1. A reciprocating linear razor comprising:

a housing functioning as a grip unit;

a head unit coupled to one side of the housing;

a razor blade cartridge disposed in a front surface of an upper portion of the head unit for cutting;

an eccentric cam module making the razor blade cartridge perform a reciprocating motion in a cutting direction, and at least one or more of vacuum-guards disposed parallel to the razor blade cartridge in a front surface of the head unit, wherein, when a vibration is generated by a reciprocating motion of the razor blade cartridge, the vacuum-guard vibrates together, and thus, a compression motion and an expansion motion are provided, wherein the vacuum-guard comprises:

a first guard adjacent to the razor blade cartridge in one side of a cutting direction of the razor blade cartridge, and disposed parallel to the razor blade cartridge; and a second guard adjacent to the razor blade cartridge in other side of the cutting direction of the razor blade cartridge, disposed parallel to the razor blade cartridge and the first guard, disposed in the same plane as the first guard, and disposed to face the first guard with respect to the razor blade cartridge, wherein the first and second side elastic cover guides are symmetrically disposed at first and second sides of the head unit, respectively, to fix the razor blade cartridge and the vacuum-guard to the head unit, the first and second sides being vertical with respect to a cutting direction of the razor blade cartridge, such that the razor blade cartridge and a vacuum-guard are configured to be attached to and detached from a front surface of an upper portion of the head unit.

2. The reciprocating linear razor of claim 1, wherein, the vacuum-guard comprises a plurality of tube-shaped hollow units disposed in a horizontal direction and vertical direction to be adjacent to each other, and formed of elastic material to maximize suction force.

3. The reciprocating linear razor of claim 1, wherein, a plurality of protrusions formed in a cylindrical shape or in a square pillar shape are disposed in a line in a periphery of a side direction of a front surface of the head unit, and a portion of the vacuum-guard is coupled to the protrusion.

4. The reciprocating linear razor of claim 1, wherein, a pair of linear bases are disposed in a periphery of a direction vertical to a side direction of a front surface of an upper portion of the head unit to support the razor blade cartridge, and the linear bases support the razor blade cartridge such that the razor blade cartridge smoothly moves when the razor blade cartridge performs an up-and-down motion.

5. The reciprocating linear razor of claim 1, wherein, a razor blade of the razor blade cartridge is fixed to the razor blade cartridge by a clip.

6. The reciprocating linear razor of claim 1, wherein, the eccentric cam module comprises:

a driver accommodated in the housing;

an eccentric cam unit disposed in the same shaft as the driver and disposed adjacent to the razor blade cartridge to provide the razor blade cartridge with up-and-down vibration depending on an operation of the driver; and speed change gears disposed between the driver and the eccentric cam unit in the same shaft as the driver and the eccentric cam unit.

7. The reciprocating linear razor of claim 1, wherein, the razor blade cartridge and a vacuum-guard are configured to be attached to and detached from a front surface of an upper portion of the head unit, and each of the side elastic cover guides is symmetrically disposed in both sides of the head unit to fix the razor blade cartridge and the vacuum-guard, the both sides being vertical to a cutting direction of the razor blade cartridge.

8. The reciprocating linear razor of claim 7, wherein, the side elastic cover guide comprises:

a bending unit coupling one side of the razor blade cartridge and the vacuum-guard to the front surface of the upper portion of the head unit;

a rotation supporting unit integrally formed with the bending unit, extended from the bending unit and rotatably accommodated in a side portion of the head unit to be coupled to the head unit; and an elastic supporting unit integrally formed with the rotation supporting unit, extended from the rotation supporting unit and disposed to be accommodated in a head unit lower portion.

9. The reciprocating linear razor of claim 1, wherein, the razor blade of the razor blade cartridge is configured with razor blades facing each other or multi-stage blades facing each other.

10. The reciprocating linear razor of claim 1, wherein, the razor blade of the razor blade cartridge is disposed such that a bi-directional cutting is performed, for improving a performance of shaving.

11. The reciprocating linear razor of claim 1, wherein, the razor blade cartridge and vacuum-guard are configured to be replaced together.

12. The reciprocating linear razor of claim 1, wherein, the head unit is coupled to the housing to rotate, and thus, a cutting direction of the razor blade cartridge is changed.

13. The reciprocating linear razor of claim 12 further comprising:

a rotation angle adjusting unit disposed between the head unit and the housing, wherein, the rotation angle adjusting unit comprises:

a plurality of grooves formed in an inner circumference surface of a head unit lower portion at an equal distance; and a plurality of protrusions formed in an outer circumference surface of a housing upper portion at a certain distance to be coupled to the grooves, and a rotation angle of the head unit is adjusted step by step.

14. The reciprocating linear razor of claim 1, wherein the vacuum-guard comprises a plurality of tube-shaped hollow units each having an opening facing away from the head unit and another opening facing toward the head unit, such that an inside of the head unit is exposed to an outside of the head unit via the tube-shaped hollow units to maximize a suction force.

15. The reciprocating linear razor of claim 1, wherein, the side elastic cover guide comprises:

a bending unit coupling one side of the razor blade cartridge and the vacuum-guard to the front surface of the upper portion of the head unit;

a rotation supporting unit integrally formed with the bending unit, extended from the bending unit and rotatably accommodated in a side portion of the head unit to be coupled to the head unit; and an elastic supporting unit integrally formed with the rotation supporting unit, extended from the rotation supporting unit and disposed to be accommodated in a head unit lower portion.

* * * * *